US007477005B2

(12) United States Patent
Hlahol et al.

(10) Patent No.: US 7,477,005 B2
(45) Date of Patent: Jan. 13, 2009

(54) FLUORESCENT LAMP PROVIDING MORE ROBUST LIGHT OUTPUT

(75) Inventors: Paul G. Hlahol, Mentor, OH (US); Joshua H. Aylsworth, Cleveland, OH (US); Lisa M. Ward, Northfield, OH (US)

(73) Assignee: General Electric Company, Schenectady, NY (US)

( * ) Notice: Subject to any disclaimer, the term of this patent is extended or adjusted under 35 U.S.C. 154(b) by 476 days.

(21) Appl. No.: 11/259,698

(22) Filed: Oct. 26, 2005

(65) Prior Publication Data

US 2007/0090736 A1 Apr. 26, 2007

(51) Int. Cl.

| | |
|---|---|
| ***H01J 1/02*** | (2006.01) |
| ***H01J 7/24*** | (2006.01) |
| ***H01J 61/52*** | (2006.01) |
| ***H01K 1/58*** | (2006.01) |

(52) U.S. Cl. ..... 313/11; 313/491; 313/493; 313/631; 313/634

(58) Field of Classification Search ..... 313/489, 313/491, 493, 552, 621, 624, 631, 634, 639, 313/318.01

See application file for complete search history.

(56) References Cited

U.S. PATENT DOCUMENTS 3,808,495 A * 4/1974 Win ..... 313/110
5,173,637 A * 12/1992 Sica ..... 313/489
5,536,998 A * 7/1996 Sica ..... 313/489
5,550,421 A * 8/1996 Scholz et al. ..... 313/25
5,729,085 A * 3/1998 Sica et al. ..... 313/493
6,534,910 B1 * 3/2003 Vose et al. ..... 313/487
2005/0082985 A1 * 4/2005 Geijtenbeek et al. ..... 313/634

* cited by examiner

*Primary Examiner*—Toan Ton
*Assistant Examiner*—Kevin Quarterman
(74) *Attorney, Agent, or Firm*—Pearne & Gordon LLP

(57) ABSTRACT

A fluorescent lamp with a thermally-insulating assembly includes an elongated glass tube. Mercury is disposed within the glass tube and a cold spot that substantially controls the vapor pressure of the mercury is present in the glass tube. One cathode stem is affixed to one end of the glass tube and extends into the glass tube a first distance. A second cathode stem is affixed to the other end of the glass tube and extends into the glass tube a second distance. The cold spot is located within a portion of the glass tube that is near the end of the glass tube where the second cathode stem is located, for example, immediately adjacent the end of the glass tube where the second cathode stem is located. A band of a thermally-insulating material substantially surrounds the portion of the glass tube where the cold spot is located and a jacket of a material capable of transmitting light substantially surrounds the glass tube.

11 Claims, 1 Drawing Sheet

FLUORESCENT LAMP PROVIDING MORE ROBUST LIGHT OUTPUT

BACKGROUND OF THE INVENTION

The present invention relates generally to fluorescent lamps that are outfitted so as to provide an increased or more robust light output, particularly when the lamps are in service in a cold environment.

Since those having ordinary skill in the art are familiar with the manner in which fluorescent lamps operate, the details thereof are not set forth here. However, it is to be noted that the interiors of fluorescent lamps comprise vacuums and the lamps typically employ mercury in its gaseous state as one of the elements for producing light. When a fluorescent lamp is turned on, an electric arc is established across the length of the lamp between the electrodes or cathode stems at opposite ends of the lamp and liquid mercury within the lamp is vaporized. The gaseous mercury, after colliding with electrons and charged atoms within the lamp, releases light photons in the ultraviolet wavelength range. These light photons interact with phosphors in the lamp to produce white light. The colder the interior of the lamp, the lower will be the vapor pressure of the mercury so that more heat will be required to vaporize the liquid mercury and cause the vaporized mercury to move within the interior of the lamp with a desired rapidity. Consequently, the output of light from the lamp will be less at lower ambient temperatures.

The vapor pressure of the mercury is governed by the coldest spot in the lamp. Typically, in a fluorescent lamp comprised of an elongated glass tube having cathode stems of substantially equal length mounted at either end of the tube, such as a T8 or T12 fluorescent lamp for example, the coldest site in the lamp is a spot, herein referred to as the "cold spot", that is located substantially at the mid-point between the ends of the tube. On the other hand, where the internal diameter of the glass tube is sufficiently small and one of the cathode stems is longer than the other and penetrates the interior of the glass tube a greater distance than the shorter cathode stem, as is the case with certain fluorescent lamps such as the T5 fluorescent lamps for example, the coldest location in the lamp is a site nearer the end of the glass tube where the longer cathode stem is in place.

The effect of the cold spot of the fluorescent lamp on the vapor pressure of the mercury and the consequent effect on the light output from the lamp is particularly significant when the lamp is in service in a cold environment such as a refrigerator or freezer. However, even at warmer ambient temperatures, the influence of the cold spot is seen.

SUMMARY OF THE INVENTION

The present invention concerns a fluorescent lamp that is provided with a thermally-insulating assembly such that the influence of the cold spot of the lamp on the vapor pressure of the mercury within the lamp is moderated. As a result, the lamp exhibits a greater or more robust light output.

In one aspect, the invention relates to a fluorescent lamp with a thermally-insulating assembly comprising an elongated glass tube having an interior and an exterior and first and second opposed ends. Mercury is disposed within the interior of the elongated glass tube and a cold spot is present within the elongated glass tube. The cold spot substantially controls the vapor pressure of the mercury. A first cathode stem is affixed to the elongated glass tube at the first end of the elongated glass tube so that one end of the first cathode stem extends into the interior of the elongated glass tube a first distance. A second cathode stem is affixed to the elongated glass tube at the second end of the elongated glass tube so that one end of the second cathode stem extends into the interior of the elongated glass tube a second distance. The second distance is sufficiently greater than the first distance, and the elongated glass tube has an internal diameter, such that the cold spot within the elongated glass tube is located within a portion of the elongated glass tube that is nearer the second end of the glass tube than the first end of the elongated glass tube. In a particular embodiment, the cold spot is located immediately adjacent the second end of the elongated glass tube. A band of a thermally-insulating material is located at the exterior of the elongated glass tube and substantially surrounds the portion of the elongated glass tube where the cold spot is located whereby the cold spot is insulated from the ambient environment. A jacket of a material capable of transmitting light substantially surrounds the elongated glass tube over substantially the entire length of the tube.

According to another aspect, the jacket of the thermally-insulating assembly comprises an elongated body that has an exterior and a substantially cylindrical interior. The elongated glass tube is disposed within the interior of the jacket, and the interior of the jacket is supported away from the exterior of the elongated glass tube.

According to a further aspect, the fluorescent lamp and thermally-insulating assembly include a spacer substantially surrounding the elongated glass tube adjacent the first end of the tube. The spacer has an outer surface and extends along the elongated glass tube, and the band of thermally-insulating material also has an outer surface and extends along the elongated glass tube. The interior of the jacket engages the outer surface of the band of thermally-insulating material and the outer surface of the spacer so that the jacket is supported away from the exterior of the elongated glass tube.

According to yet another aspect, the length to which the band of thermally-insulating member extends along the elongated glass tube is greater than the length to which the spacer extends along the elongated glass tube.

According to still another aspect, the fluorescent lamp and thermally-insulating assembly include a respective metal cap that seals off each end of the elongated glass tube and a respective collar arranged around the jacket where each of the band of thermally-insulating material and spacer is located. Each collar is heat-shrunk to the jacket and a respective metal cap so as to hold in place on the elongated glass tube the jacket, the band of thermally-insulating material and the spacer.

For a better understanding of the invention reference maybe made to the following description of an embodiment of the invention, taken in conjunction with the accompanying drawing.

BRIEF DESCRIPTION OF THE DRAWING

The drawing is a somewhat schematic representation, partly in cross-section, of a side view of an embodiment of the fluorescent lamp and thermally-insulating assembly of the invention.

DESCRIPTION OF AN EMBODIMENT OF THE INVENTION

Figure 1:
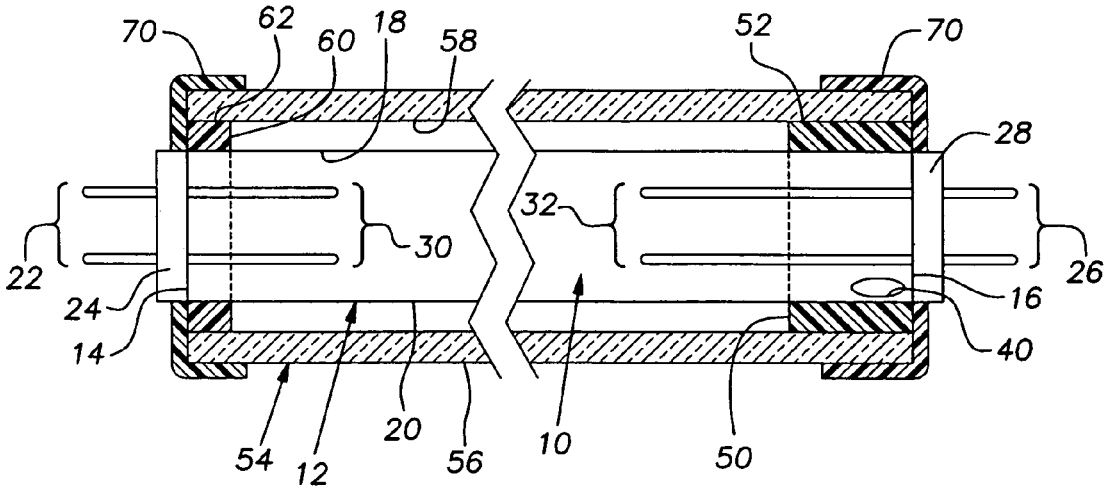

The drawing illustrates a fluorescent lamp, indicated generally at 10. The lamp includes a cylindrical, elongated glass tube 12 having first and second opposed ends 14 and 16, respectively, an interior 18 and an exterior 20. A first cathode stem 22 is affixed to the first end 14 of the elongated glass tube 12 by means of a metal closure cap 24 that closes off the first end 14 of the glass tube 12. Similarly, a second cathode stem 26 is affixed to the second end 16 of the elongated glass tube 12 by means of a metal closure cap 28 that closes off the second end 16 of the glass tube.

As shown in the drawing, one end 30 of the first cathode stem 22 and one end 32 of the second cathode stem 26 extend into the interior 18 of the elongated glass tube 12. It can be seen from the drawing that the one end 30 of the first cathode stem 22 extends into the interior of the glass tube 12 a first distance, and the one end 32 of the second cathode stem 26 extends into the interior of the glass tube 12 a second distance, with the second distance being greater than the first distance.

It will be understood to those having ordinary skill in the art that fluorescent lamps contain mercury as an element that is integral to the process by which light is produced in the lamps. When a fluorescent lamp is turned off, the mercury exists as a liquid in the lamp. When the lamp is operating, at least a portion the mercury is in a gaseous state in the lamp. More specifically, at the time a fluorescent lamp is turned on, an electric arc is established between the two electrodes or cathode stems at opposite ends of the elongated glass tube that is apart of the lamp. The heat generated by the electric arc vaporizes the liquid mercury, and the resulting gaseous mercury enters into the process by which light is generated by the lamp.

In certain types of fluorescent lamps that are in general use, such as T8 and T12 lamps for example, the cathode stems at the ends of the elongated glass tubes that are apart of the lamps, essentially, are of equal length so that they extend into the interior of the glass tubes the same distance, unlike the case with the cathode stems illustrated in the drawing and described above. In the types of fluorescent lamps where the cathode stems are of equal length, the coldest spot within the glass tubes, referred to herein as the "cold spot", are located substantially at the mid-points between the ends of the tubes. It is the case that the temperature at the cold spot governs the vapor pressure of the mercury within the glass tubes and, consequently, at lower ambient temperatures, such as exist in refrigerators and freezers, adversely affects the ability of the mercury to vaporize and the ability of the gaseous mercury to attain a state of movement required for the mercury to carry out its role in the light-generating process.

In the embodiment of the invention shown in the drawing, mercury (not shown) is disposed within the interior of the elongated glass tube 12. Additionally, a cold spot 40 that governs the vapor pressure of the mercury is present in the glass tube. However, rather than being located at the mid-point of the glass tube as described above, the cold spot is located within a portion of the glass tube that is nearer the second end 16 of the tube 12 than the first end 14 of the tube 12. More specifically, in the embodiment of the invention shown in the drawing, the cold spot is located immediately adjacent the second end 16 of the elongated glass tube 12.

The reason that the cold spot 40 is located in the elongated glass tube 12 immediately adjacent the second end 16 of the glass tube as illustrated in the drawing is two-fold. First, the internal diameter of the glass tube is such that the electric arc formed between the cathode stems 22 and 26 when the lamp is turned on is so slight that it does not significantly preferentially heat any portion of the interior of the glass tube. Second, the end 32 of the longer cathode stem 26, where one end of the electric arc originates, is sufficiently removed from the end 16 of the glass tube 12 that the end 16 will be least exposed to the heat generated by the electric arc. An example of fluorescent lamps that have their cold spots located adjacent the ends of the glass tubes where the longer cathode stems are affixed are the class of lamps identified as T5 lamps. However, the present invention is not limited to T5 lamps. The present invention would also have application to other lamps having cathode stems of different lengths and cold spots located nearer the longer cathode stems than the shorter cathode stems, although not necessarily at the very ends of the glass tubes where the longer cathode stems are affixed.

It has been determined that a greater output of light from the fluorescent lamps can be provided if the cold spot in the glass tube of the lamp is insulated. This is the case over a wide range of ambient temperatures but is particularly true at lower ambient temperatures such as exist in refrigerators and freezers. It also has been found that insulating the cold spot broadens the temperature range over which the fluorescent lamp maintains its maximum light output.

In the embodiment of the invention shown in the drawing, the cold spot 40 is insulated by a band of thermally-insulating material 50. The thermally-insulating material can comprise essentially any material that is capable of providing thermal insulation to the cold spot such as, for example, a polymeric foam. The band 50 is located at the exterior 20 of the elongated glass tube 12 and substantially surrounds and engages the portion of the glass tube where the cold spot 40 is located, whereby the cold spot is insulated from the ambient environment. In the embodiment of the invention shown in the drawing, the band 50 entirely surrounds the portion of the glass tube 12 where the cold spot is located. The band of thermally-insulating material 50 includes an outer surface 52 and extends along the elongated glass tube 12 an appropriate length. The length of the band 50 must be great enough to insulate the cold spot 40 adequately to increase the light output from the lamp but not so great as to interfere with the light output to an undesirable degree. By way of example, the length of the band 50 can be from one inch to three inches.

Also comprising an element of the fluorescent lamp and thermally-insulating assembly of the invention is a jacket 54 of a material capable of transmitting light. The jacket can be transparent or translucent and, for example, can be made of quartz, glass or a thermoplastic resin such as a polycarbonate resin. The jacket 54 substantially surrounds the elongated glass tube 12 over substantially the entire length of the glass tube. In the embodiment of the invention shown in the drawing, the jacket comprises an elongated body having an exterior 56 and a substantially cylindrical interior 58, within which the elongated glass tube 12 is disposed, so as to completely surround the elongated glass tube 12. The interior 58 of the jacket 54 is supported away from the exterior 20 of the elongated glass tube 12 and the air space thereby created contributes additionally to the thermal insulation of the lamp.

As illustrated in the embodiment of the invention shown in the drawing, to aid in supporting the jacket 54 on the elongated glass tube 12, a spacer 60 having an outer surface 62 is mounted on the glass tube so as to extend along the glass tube. In the embodiment illustrated in the drawing, the spacer 60 completely surrounds the glass tube 12 and is located adjacent the first end 14 of the glass tube.

In the embodiment of the invention shown in the drawing, the interior 58 of the jacket 54 engages the outer surface 52 of the band of thermally-insulating material 50 and the outer surface 62 of the spacer 60 so that the jacket 54 is supported away from the exterior 20 of the elongated glass tube.

Because the spacer 60 is not required to provide insulation to the glass tube 12, it can be made of a variety of materials that are capable of providing support to the jacket 54 and need not be made of an insulating material. It may be convenient, however, to make the spacer 60 of the same material as the thermally-insulating band 50. Additionally, the length to which the spacer 60 extends along the elongated glass tube 12 can be shorter than the length to which the thermally-insulating band 50 extends along the tube as shown in the drawing.

For the purpose of securely maintaining in place the components of the embodiment of the invention described above, collars 70 can be provided. A respective collar 70 can be arranged around the jacket 54 where each of the band of thermally-insulating material 50 and the spacer 60 is located. Each respective collar 70 can be made of a material, such as a heat-shrinkable polymeric material, for example, that can be heat shrunk to the jacket 54 and a respective metal cap 24 or 28 so as to hold in place on the elongated glass tube 12 the jacket 54, the band of thermally-insulating material 50 and the spacer 60. Other means may be provided for maintaining the components of the of the embodiment of the invention described above in place. For example, rather than being made of a material that is heat-shrinkable, the collars can be made of a molded plastic and the collars fastened to the jacket and caps by a suitable adhesive.

In certain instances, the elongated glass tube 12 of the fluorescent lamp can be provided with only the band of thermally-insulating material 50. In other words, the jacket 54, spacer 60 and collars 70 can be dispensed with. In that case, the band of thermally-insulating material can be secured to the glass tube 12 in any suitable fashion such as, for example, by the use of an adhesive applied to the interior of the band 50 or by simply having the internal diameter of the band be smaller than the outer diameter of the glass tube 12 so that the band can be stretch-fitted onto the glass tube.

The invention has been described with respect to a specific embodiment. However, it will be recognized by those skilled in the art that the invention can be practiced with modifications that are within the spirit and the scope of the claims that follow.

What is claimed is:

1. A fluorescent lamp with a thermally-insulating assembly comprising:

an elongated glass tube having an interior and an exterior and first and second opposed ends, mercury being disposed within the interior of the elongated glass tube and a cold spot present within the elongated glass tube that substantially controls the vapor pressure of the mercury;

a first cathode stem affixed to the elongated glass tube at the first end of the elongated glass tube, one end of the first cathode stem extending into the interior of the elongated glass tube a first distance;

a second cathode stem affixed to the elongated glass tube at the second end of the elongated glass tube, one end of the second cathode stem extending into the interior of the elongated glass tube a second distance, the second distance being sufficiently greater than the first distance, and the elongated glass tube having an internal diameter, such that the cold spot within the elongated glass tube is located within a portion of the elongated glass tube that is nearer the second end of the glass tube than the first end of the elongated glass tube; and a band of a thermally-insulating material located at the exterior of the elongated glass tube and substantially surrounding the portion of the elongated glass tube where the cold spot is located whereby the cold spot is insulated from the ambient environment.

2. The fluorescent lamp and thermally-insulating assembly of claim 1 wherein a jacket of a material capable of transmitting light substantially surrounds the elongated glass tube over substantially the entire length of the elongated glass tube.

3. The fluorescent lamp and thermally-insulating assembly of claim 2 wherein:

the jacket comprises an elongated body having an exterior and a substantially cylindrical interior;

the elongated glass tube is disposed within the interior of the jacket; and the interior of the jacket is supported away from the exterior of the elongated glass tube.

4. The fluorescent lamp and thermally-insulating assembly of claim 3 further comprising a spacer substantially surrounding the elongated glass tube adjacent the first end of the elongated glass tube, the spacer having an outer surface and extending along the elongated glass tube and wherein:

the band of thermally-insulating material has an outer surface and extends along the elongated glass tube; and the interior of the jacket engages the outer surface of the band of thermally-insulating material and the outer surface of the spacer so that the jacket is supported away from the exterior of the elongated glass tube.

5. The fluorescent lamp and thermally-insulating assembly of claim 2 wherein the cold spot is located immediately adjacent the second end of the elongated glass tube.

6. The fluorescent lamp and thermally-insulating assembly of claim 5 wherein:

the jacket comprises an elongated body having an exterior and a substantially cylindrical interior;

the elongated glass tube is disposed within the interior of the jacket;

and the interior of the jacket is supported away from the exterior of the elongated glass tube.

7. The fluorescent lamp and thermally-insulating assembly of claim 6 further comprising a spacer substantially surrounding the elongated glass tube adjacent the first end of the elongated glass tube, the spacer having an outer surface and extending along the elongated glass tube and wherein:

the band of thermally-insulating material has an outer surface and extends along the elongated glass tube; and the interior of the jacket engages the outer surface of the band of thermally-insulating material and the outer surface of the spacer so that the jacket is supported away from the exterior of the elongated glass tube.

8. A fluorescent lamp with a thermally-insulating assembly comprising:

an elongated glass tube having an interior and an exterior and first and second opposed ends, mercury being disposed within the interior of the elongated glass tube and a cold spot present within the elongated glass tube that substantially controls the vapor pressure of the mercury;

a first cathode stem affixed to the elongated glass tube at the first end of the elongated glass tube, one end of the first cathode stem extending into the interior of the elongated glass tube a first distance;

a second cathode stem affixed to the elongated glass tube at the second end of the elongated glass tube, one end of the second cathode stem extending into the interior of the elongated glass tube a second distance, the second distance being sufficiently greater than the first distance, and the elongated glass tube having an internal diameter, such that the cold spot within the elongated glass tube is located within a portion of the elongated glass tube that is nearer the second end of the glass tube than the first end of the elongated glass tube;

a band of a thermally-insulating material located at the exterior of the elongated glass tube and substantially surrounding the portion of the elongated glass tube where the cold spot is located whereby the cold spot is insulated from the ambient environment, the band of thermally-insulating material having an outer surface and extending along the elongated glass tube;

a jacket of a material capable of transmitting light substantially surrounding the elongated glass tube over substantially the entire length of the elongated glass tube, wherein the jacket comprises an elongated body having an exterior and a substantially cylindrical interior, the elongated glass tube is disposed within the interior of the jacket and the interior of the jacket is supported away from the exterior of the elongated glass tube; and a spacer substantially surrounding the elongated glass tube adjacent the first end of the elongated glass tube, the spacer having an outer surface and extending along the elongated glass tube, wherein the interior of the jacket engages the outer surface of the spacer so that the jacket is supported away from the exterior of the elongated glass tube and the length to which the band of thermally-insulated member extends along the elongated glass tube is greater than the length to which the spacer extends along the elongated glass tube.

9. The fluorescent lamp and thermally-insulating assembly of claim 8 further comprising a respective metal cap sealing off each end of the elongated glass tube and a respective collar arranged around the jacket where each of the band of thermally-insulating material and the spacer is located and being fastened to the jacket and a respective metal cap so as to hold in place on the elongated glass tube the jacket, the band of thermally-insulating material and the spacer.

10. A fluorescent lamp with a thermally-insulating assembly comprising:

an elongated glass tube having an interior and an exterior and first and second opposed ends, mercury being disposed within the interior of the elongated glass tube and a cold spot present within the elongated glass tube that substantially controls the vapor pressure of the mercury, the cold spot being located immediately adjacent the second end of the elongated glass tube;

a first cathode stem affixed to the elongated glass tube at the first end of the elongated glass tube, one end of the first cathode stem extending into the interior of the elongated glass tube a first distance;

a second cathode stem affixed to the elongated glass tube at the second end of the elongated glass tube, one end of the second cathode stem extending into the interior of the elongated glass tube a second distance, the second distance being sufficiently greater than the first distance, and the elongated glass tube having an internal diameter, such that the cold spot within the elongated glass tube is located within a portion of the elongated glass tube that is nearer the second end of the glass tube than the first end of the elongated glass tube;

a band of a thermally-insulating material located at the exterior of the elongated glass tube and substantially surrounding the portion of the elongated glass tube where the cold spot is located whereby the cold spot is insulated from the ambient environment, the band of thermally-insulating material having an outer surface and extending along the elongated glass tube;

a jacket of a material capable of transmitting light substantially surrounding the elongated glass tube over substantially the entire length of the elongated glass tube, wherein the jacket comprises an elongated body having an exterior and a substantially cylindrical interior, the elongated glass tube is disposed within the interior of the jacket and the interior of the jacket is supported away from the exterior of the elongated glass tube; and a spacer substantially surrounding the elongated glass tube adjacent the first end of the elongated glass tube, the spacer having an outer surface and extending along the elongated glass tube, wherein the interior of the jacket engages the outer surface of the spacer so that the jacket is supported away from the exterior of the elongated glass tube and the length to which the band of thermally-insulated member extends along the elongated glass tube is greater than the length to which the spacer extends along the elongated glass tube.

11. The fluorescent lamp and thermally-insulating assembly of claim 10 further comprising a respective metal cap sealing off each end of the elongated glass tube and a respective collar arranged around the jacket where each of the band of thermally-insulating material and the spacer is located and being fastened to the jacket and a respective metal cap so as to hold in place on the elongated glass tube the jacket, the band of thermally-insulating material and the spacer.

* * * * *